US009229398B2

(12) United States Patent
Tomono

(10) Patent No.: US 9,229,398 B2
(45) Date of Patent: Jan. 5, 2016

(54) IMAGE FORMING APPARATUS

(71) Applicant: CANON KABUSHIKI KAISHA, Tokyo (JP)

(72) Inventor: Toshiro Tomono, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/277,246

(22) Filed: May 14, 2014

(65) Prior Publication Data

US 2014/0348522 A1 Nov. 27, 2014

(30) Foreign Application Priority Data

May 24, 2013 (JP) ..... 2013-109998

(51) Int. Cl.

| | |
|---|---|
| ***G03G 21/20*** | (2006.01) |
| ***G03G 15/00*** | (2006.01) |
| ***G03G 21/18*** | (2006.01) |
| *G03G 15/16* | (2006.01) |
| *G03G 15/02* | (2006.01) |

(52) U.S. Cl.

CPC ..... *G03G 15/50* (2013.01); *G03G 21/1878* (2013.01); *G03G 15/0266* (2013.01); *G03G 15/1675* (2013.01); *G03G 15/5033* (2013.01); *G03G 21/20* (2013.01); *G03G 2215/00084* (2013.01); *G03G 2215/00772* (2013.01); *G03G 2215/0132* (2013.01)

(58) Field of Classification Search

CPC ..... G03G 21/20
USPC ..... 399/44
See application file for complete search history.

(56) References Cited

U.S. PATENT DOCUMENTS

| | | | | |
|---|---|---|---|---|
| 5,191,362 | A * | 3/1993 | Ichikawa | 347/131 |
| 5,585,825 | A * | 12/1996 | Kneezel et al. | 347/14 |
| 6,042,215 | A | 3/2000 | Imai | |
| 6,768,882 | B2 * | 7/2004 | Omoto et al. | 399/69 |
| 6,788,904 | B2 * | 9/2004 | York | 399/44 |
| 7,692,820 | B2 * | 4/2010 | Rogalski et al. | 358/406 |
| 7,970,299 | B2 * | 6/2011 | Sato | 399/44 |
| 2009/0226202 | A1 * | 9/2009 | Kinouchi et al. | 399/69 |
| 2014/0064756 | A1 * | 3/2014 | Sugiyama et al. | 399/44 |
| 2014/0348522 | A1 * | 11/2014 | Tomono | 399/44 |

FOREIGN PATENT DOCUMENTS

| | | | | |
|---|---|---|---|---|
| JP | 5-16370 | A | 1/1993 | |
| JP | 11-272147 | A | 10/1999 | |
| JP | 2003-005614 | A | 1/2003 | |
| JP | 2003-270920 | * | 9/2003 | G03G 15/08 |
| JP | 2003-270920 | A | 9/2003 | |
| JP | 2006-247882 | A | 9/2006 | |

OTHER PUBLICATIONS

Search Report issued in UK Patent Application No. GB1408842.1, dated Oct. 31, 2014.

* cited by examiner

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image forming apparatus includes a body, a cartridge, detachably mountable to the body, configured to form a toner image, an information recording portion provided in the cartridge and configured to record information, a control portion provided in the body and configured to electrically communicate with the information recording portion, and a connector provided in the body and configured to electrically connect the control portion with the information recording portion. The connector has a temperature detecting portion configured to detect temperature.

16 Claims, 12 Drawing Sheets

FIG.9A INTRA-APPARATUS BODY TEMPERATURE
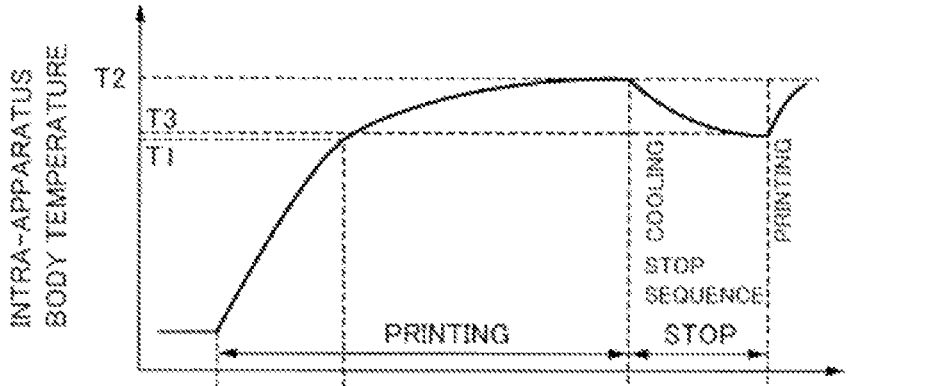
FIG.9B
PRODUCTIVITY
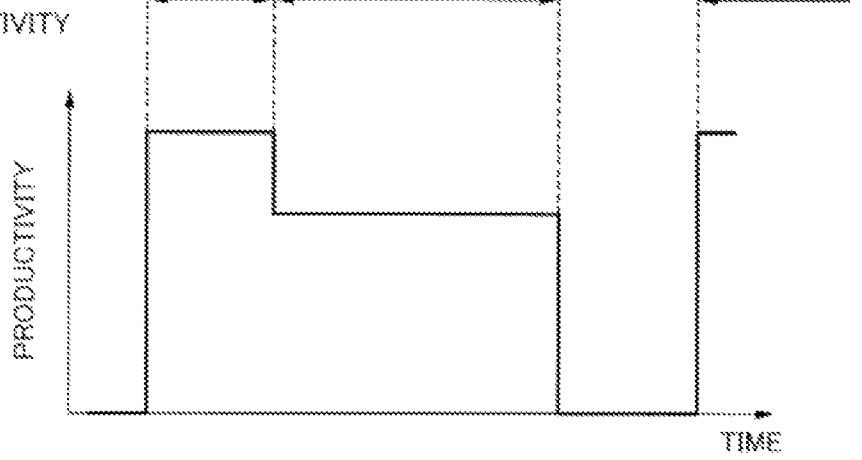

FIG.10A INTRA-APPARATUS BODY TEMPERATURE
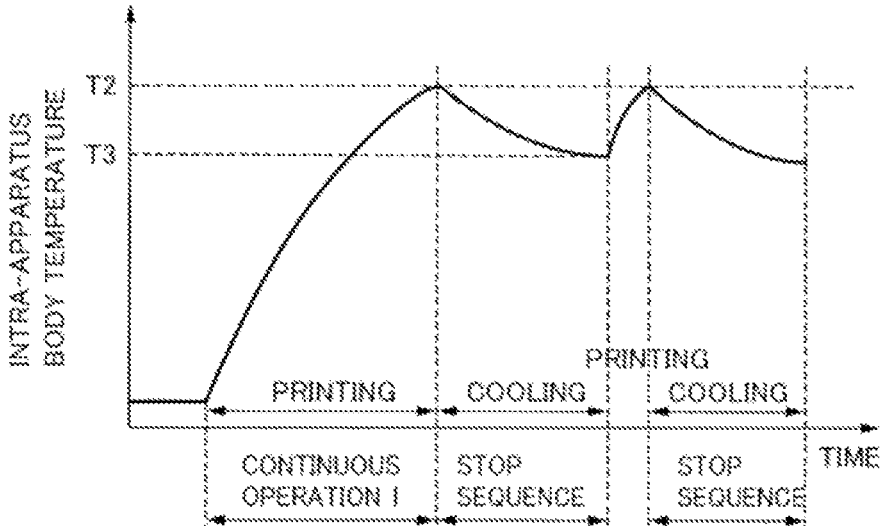
FIG.10B PRODUCTIVITY
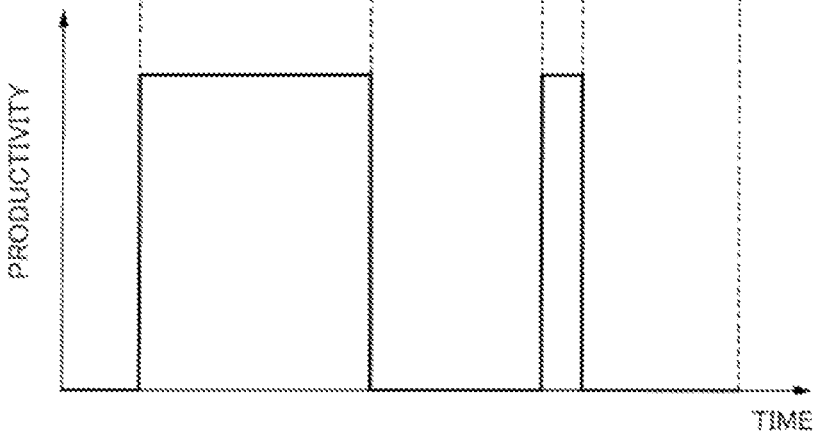

IMAGE FORMING APPARATUS

BACKGROUND OF THE INVENTION

1. Field of the Invention

The present invention relates to an image forming apparatus configured to form an image.

2. Description of the Related Art

An image forming apparatus is configured to form a toner image by developing an electrostatic image formed on a photoconductive drum by a developing unit, to transfer the toner image thus formed to a recording medium directly or through an intermediate transfer body, and to fix an image on the recording medium by applying heat and pressure to the recording medium to which the toner image has been transferred. A cartridge is a replacement unit in which the photoconductive drum and the developing unit are integrated and is detachably mounted to the body of the image forming apparatus.

In response to a start of the image forming apparatus, developer is agitated and rubbed within the developing unit, and a temperature of the developer gradually increases and converges to a temperature corresponding to an ambient temperature of the developing unit. It is not preferable to expose the developer to high temperature because fluidity of the developer within the developing unit is hampered for example. To that end, a conventional image forming apparatus is provided with temperature sensors at predetermined positions within the image forming apparatus. Then, if the temperature sensors detect a final threshold temperature, e.g. 100° C., the image forming apparatus is prohibited from forming an image more than what has been formed and is required to be inspected and its part is replaced and is reset by a serviceman. Or, image forming apparatuses of Japanese Patent Application Laid-open Nos. 2003-5614 and H11-272147 are provided with a cooling fan therein and an output of the cooling fan is automatically controlled such that a temperature of a developing unit is kept within a predetermined temperature range.

If a temperature sensor is disposed within a developing unit (including a case where the developing unit is built in a cartridge) to directly measure a temperature of developer, the temperature sensor ends up being replaced in replacing the developing unit. Although the temperature sensor may be used even when the developing unit is replaced in a case where the temperature sensor is disposed outside of the developing unit as disclosed in JPA Nos. 2003-5614 and H11-272147, detected temperatures of the temperature sensor largely differ depending on a state of contact and a distance between the temperature sensor and the developing unit. Even if an increase or a drop of a temperature of the developer within the developing unit may be determined from an output of the temperature sensor, it is difficult to accurately estimate an actual temperature level of the developer within the developing unit.

Then, there is proposed an arrangement in which an engage part dedicated for a temperature sensor is provided on an outer wall of the developing unit and the temperature sensor suspended from a body side by bundled wires is attached to/removed from the engage part dedicated for the temperature sensor in replacing the developing unit. In this case, however, although reproducibility of the state of contact of the developing unit and the temperature sensor is high, this arrangement requires the engage part dedicated for the temperature sensor and the dedicated bundled wires and adds another work of attaching/removing the temperature sensor in replacing the developing unit.

SUMMARY OF THE INVENTION

According to a first aspect of the present invention, an image forming apparatus includes a body, a cartridge, detachably mountable to the body, configured to form a toner image, an information recording portion provided in the cartridge and configured to record information, a control portion provided in the body and configured to electrically communicate with the information recording portion, and a connector provided in the body and configured to electrically connect the control portion with the information recording portion, the connector having a temperature detecting portion configured to detect temperature.

According to a second aspect of the present invention, an image forming apparatus configured to be able to mount a cartridge forming a toner image detachably, includes a body, and a connector provided in the body and including electric contact electrically connecting with an information recording portion provided in the cartridge and a temperature detecting portion detecting a temperature, wherein the connector is connected with a power source supplying line supplying power source to the information recording portion and the temperature detecting portion through the electric contact.

According to a third aspect of the present invention, an image forming apparatus includes a developing unit developing an electrostatic image on a photoconductive body as a toner image by using developer, a body to which the developing unit is detachably mounted, a first connector fixed to the developing unit, a second connector disposed on the body side and detachably connected to the first connector to electrically communicate with the first connector, and a temperature detecting element disposed on the second connector.

Further features of the present invention will become apparent from the following description of exemplary embodiments with reference to the attached drawings.

BRIEF DESCRIPTION OF THE DRAWINGS

FIG. 9A is a graph illustrating an intra-apparatus body temperature in a case where a control of image intervals is executed based on an estimated temperature.

FIG. 9B is a graph illustrating productivity in the case where the control of image intervals is executed based on the estimated temperature.

FIG. 10A is a graph illustrating an intra-apparatus body temperature in a case where another control of image intervals is executed based on an estimated temperature.

FIG. 10B is a graph illustrating productivity in the case where the other control of image intervals is executed based on the estimated temperature.

DESCRIPTION OF THE EMBODIMENTS

Embodiments of the present invention will be described in detail below with reference to the drawings.

First Embodiment

Figure 1:
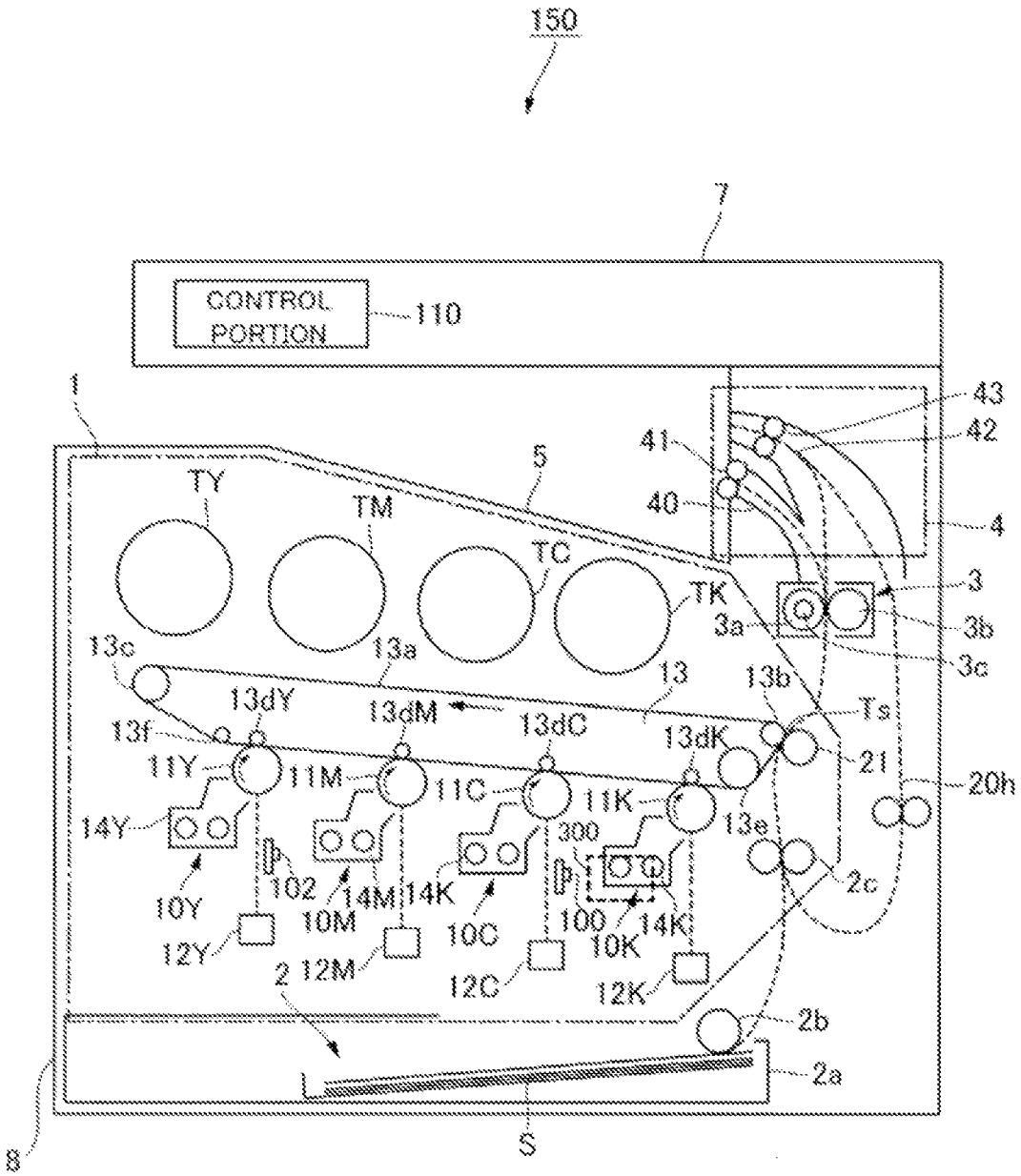
FIG. 1 is a schematic diagram illustrating a configuration of an image forming apparatus.
Figure 5:
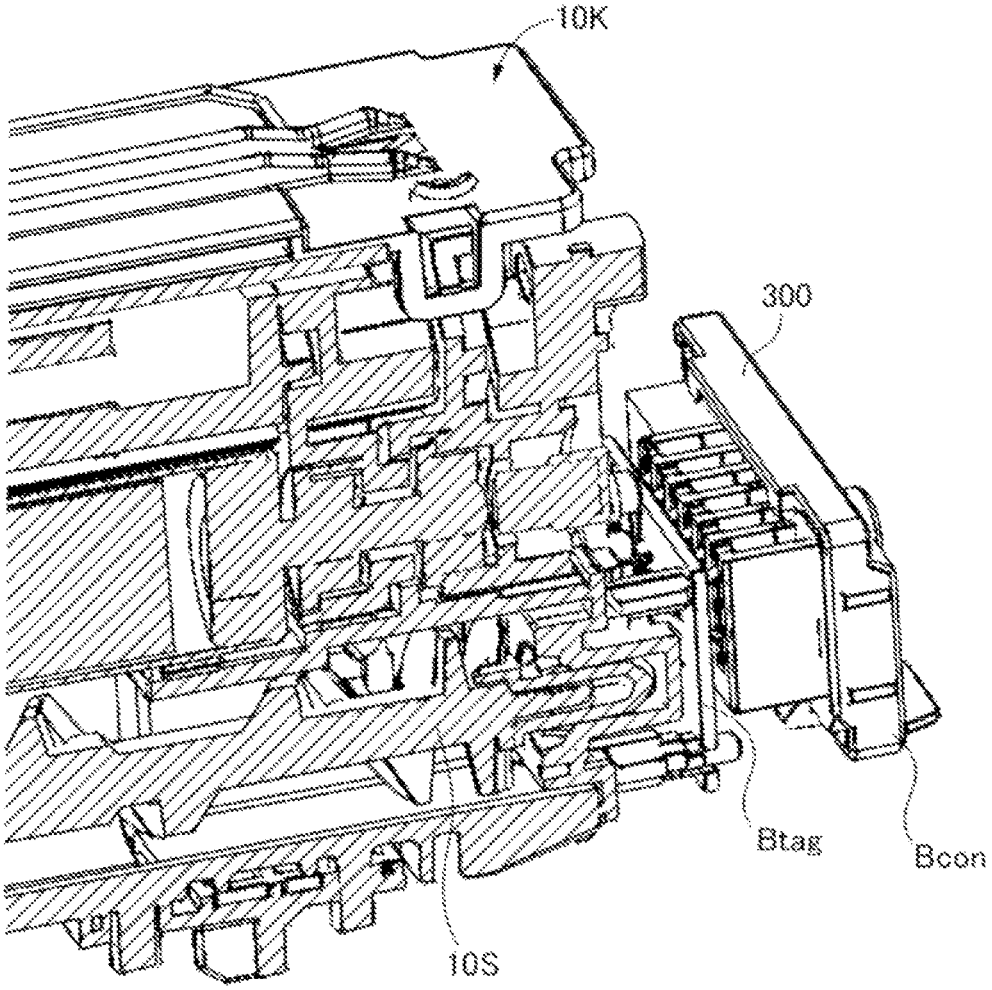
FIG. 5 is a partially enlarged view illustrating a heat transmission route between a developing unit and a thermistor.
Figure 6:
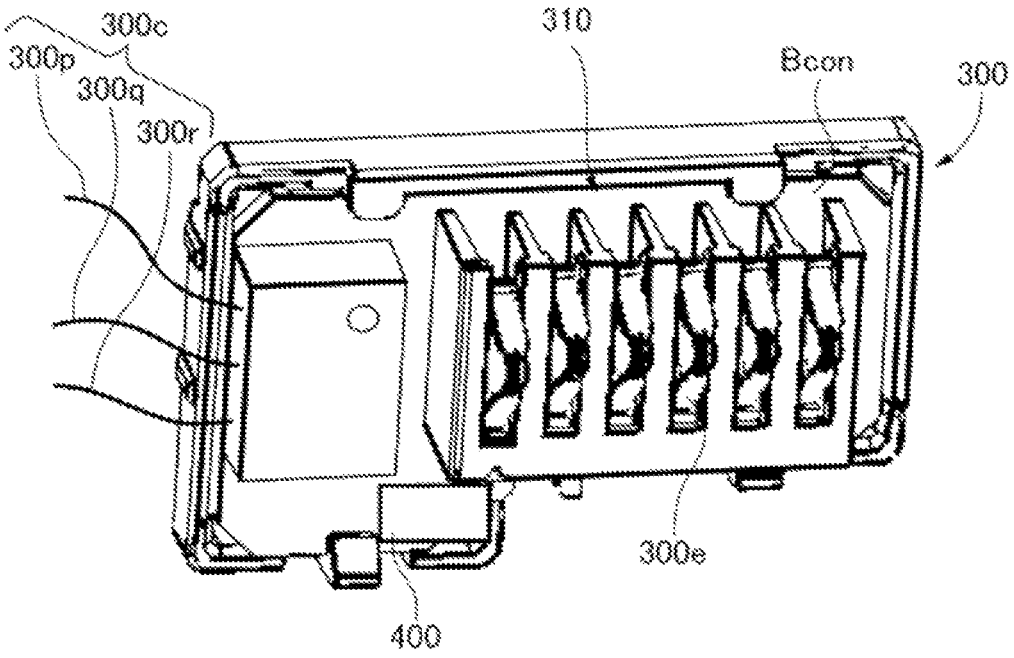
FIG. 6 is a partially enlarged view illustrating a disposition of the thermistor in the connector.

As shown in FIG. 1, an image forming apparatus 150 is configured such that a process cartridge 10K, i.e., an exemplary cartridge, for forming a toner image can be detachably mounted thereto. As shown in FIG. 5, a connector board Bcon, i.e., one exemplary transmitting/receiving portion, transmits/receives information to/from a tag board Btag, i.e., one exemplary information recording portion, provided in the process cartridge 10K. As shown in FIG. 6, the connector board Bcon has a thermistor 400, i.e., one exemplary temperature detecting portion, detecting a temperature of the process cartridge 10K on a common electrical board.

The connector board Bcon has a common power supplying portion supplying electric power to the transmitting/receiving portion and the temperature detecting portion and an electric contact (electric contact portion) 310 with the tag board Btag. The process cartridge 10K stores toner for use in forming a toner image and includes a photoconductive drum and a developing unit 14K configured to develop an electrostatic image formed on the photoconductive drum by the toner.

A developing portion 14K, i.e., one exemplary developing unit, of the process cartridge 10K is configured to develop the electrostatic image of a photoconductive drum 11K, i.e., one exemplary photoconductive drum, as the toner image by using developer. The process cartridge 10K is a replacement unit constructed by integrally combining the photoconductive drum 11K with the developing unit 14K. The process cartridge 10K is detachably mounted in a body 8 of the image forming apparatus 150. The process cartridge 10K is disposed such that the process cartridge 10K can be drawn out of the body 8 of the image forming apparatus 150 in a direction of a rotation axis of the photoconductive drum. An intermediate transfer belt 13*a*, i.e., one exemplary intermediate transfer body, is stretched around a plurality of support rotary members, and a plurality of the process cartridges 10Y, 10M, 10C, and 10K is disposed such that the photoconductive drums 11Y, 11M, 11C, and 11K are in contact with a stretched surface of the intermediate transfer belt 13*a*. A secondary transfer portion Ts, i.e., one exemplary transfer portion, is disposed at one end in a direction of the suspension of the intermediate transfer belt 13*a* and transfers the toner image to a recording medium conveyed thereto upward. A fixing apparatus 3, i.e., one exemplary image heating portion, is disposed above the secondary transfer portion Ts and heats the recording medium on which the toner image has been transferred.

(Image Forming Apparatus)

FIG. 1 illustrates a configuration of the image forming apparatus. As shown in FIG. 1, the image forming apparatus 150 is a tandem intermediate transfer type full-color printer in which the process cartridges 10Y, 10M, 10C, and 10K are arrayed along a downside surface of the intermediate transfer belt 13*a*. The image forming apparatus 150 includes an image forming portion 1, a recording medium feed portion 2, the fixing apparatus 3, a recording medium discharge portion 4, a recording medium stacking portion 5, a document reading unit 7, and an intermediate transfer unit 13.

A yellow toner image is formed on the photoconductive drum 11Y in the process cartridge 10Y and is transferred to the intermediate transfer belt 13*a*. Magenta, cyan, and black toner images are also formed respectively on the photoconductive drums 11M, 11C and 11K in the process cartridges 10M, 10C and 10K and are transferred to the intermediate transfer belt 13*a*.

The four color toner images transferred to the intermediate transfer belt 13*a* are conveyed to the secondary transfer portion Ts to be secondarily transferred to the recording medium S. A separation roller 2*b* separates the recording medium S drawn out of a recording medium cassette 2*a* one by one and sends the recording medium S to a registration roller 2*c*. The registration roller 2*c* sends the recording medium S to the secondary transfer portion Ts by matching timing with the toner image on the intermediate transfer belt 13*a*. The fixing apparatus 3 applies heat and pressure to the recording medium S on which the toner image has been secondarily transferred at a nip portion between a fixing roller 3*a* and a pressure roller 3*b* thereof to fix the image on a surface of the recording medium S. The recording medium S is then stacked on the recording medium stacking portion 5 by going through a discharge path 40 and a discharge roller pair 41.

In a case of duplex printing, the recording medium is sent to a discharge path 42, is switched back by a discharge roller pair 43, is conveyed to a reverse conveying path 20*h*, and is fed to the registration roller 2*c* again. The recording medium is sent to the secondary transfer portion Ts by the registration roller 2*c* in a state in which front and back surfaces and front and rear parts thereof are reversed such that a toner image is transferred on the back surface thereof. Then, the fixing apparatus 3 applies heat and pressure to the recording medium S on which the toner image has been secondarily transferred to fix the image on the back surface, and the recording medium S is stacked on the recording medium stacking portion 5 by going through the discharge path 40 and the discharge roller pair 41.

(Process Cartridge)

The process cartridges 10Y, 10M, 10C, and 10K are constructed substantially in the same manner except that colors of toners used in the respective developing units 14Y, 14M, 14C and 14K are different as yellow, magenta, cyan, and black. Accordingly, only the process cartridge 10K will be explained and an overlapped explanation of the process cartridges 10Y, 10M, and 10C will be omitted in the following explanation. The process cartridge 10K is a replacement unit in which a charging unit, a developing unit 14K and a drum cleaning unit are combined integrally with the photoconductive drum 11K.

The charging unit, an exposure unit 12K, the developing unit 14K, a transfer roller 13*d*K, the drum cleaning unit are disposed around the photoconductive drum 11K. The photoconductive drum 11K includes a photosensitive layer formed around an outer circumferential surface of an aluminum cylinder and rotates at a predetermined process speed.

The charging unit charges the photoconductive drum 11K with a uniform negative potential by using a charging roller. The exposure unit 12K scans a laser beam by a rotational mirror to write an electrostatic image of an image on the surface of the photoconductive drum 11K. The developing unit 14K develops the electrostatic image on the photoconductive drum 11K as a toner image by using developer containing toner and carrier. New toner of an amount corresponding to a consumed toner amount by the developing unit 14K is replenished from a toner bottle TK to the developing unit 14K through a toner conveying path not shown.

The transfer roller 13*d*K forms a primary transfer portion of the toner image between the photoconductive drum 11K and the intermediate transfer belt 13*a*. The negative toner image carried on the photoconductive drum 11K is transferred to the intermediate transfer belt 13*a* as a positive DC voltage is applied to the transfer roller 13*d*K. The drum cleaning unit recovers transfer residual toner attaching on the surface of the photoconductive drum 11K.

The intermediate transfer belt 13*a* is stretched around and supported by a tension roller 13*c*, a driving roller 13*b* that functions also as a secondary transfer inner roller, and stretch rollers 13*e* and 13*f*, and is driven by the driving roller 13*b* and rotates in a direction of an arrow. A secondary transfer outside roller 21 forms the secondary transfer portion Ts by being in contact with the intermediate transfer belt 13*a* supported by the driving roller 13*b*. The toner image on the intermediate transfer belt 13*a* is transferred to the recording medium S as a positive DC voltage is applied to the secondary transfer outside roller 21. A belt cleaning unit not shown recovers transfer residual toner attaching on the surface of the intermediate transfer belt 13*a*.

(Temperature Rise of Image Forming Portion)

In response to a start of the image forming apparatus 150 shown in FIG. 1, the fixing roller 3*a* of the fixing apparatus 3 is heated at first and a temperature of air within the body 8 of the image forming apparatus 150 rises. When a center part of the fixing roller 3*a* reaches a fixing temperature, e.g., 180° C., the image forming portion 1 starts to form a toner image and to transfer the toner image to a recording medium.

If the image forming portion 1 is continuously operated after that, a temperature of the process cartridge 10K gradually rises. A factor of the temperature rise of the process cartridge 10K includes frictional heat between the photoconductive drum 11K and a bearing supporting the photoconductive drum 11K and frictional heat caused by rubbing between the photoconductive drum 11K and the drum cleaning unit. Frictional heat between the developing sleeve and a bearing supporting a screw member within the developing unit 14K, frictional heat between a layer thickness restricting member restricting a thickness of a layer of the developer carried on the developing sleeve and the developer, and frictional heat between the screw and the developer within the developing unit 14K are also included in the factor. Heat generated at a toner carrying portion, a rubbing portion, a power source, a motor and the like of the image forming portion 1 disposed outside of the process cartridge 10K are also included in the factor.

Heat generated by the fixing apparatus 3 and the recording medium heated by the fixing apparatus 3 are also the main factor of the temperature rise of the process cartridge 10K. A predetermined power is consumed every time when the recording medium is heated by the fixing apparatus 3 and a part of the power consumption is radiated within the image forming apparatus 150 and heats the process cartridge 10K. In the case of the duplex printing in particular, a high temperature recording medium heated by the fixing apparatus 3 passes through the image forming portion 1, thus remarkably raising the temperature of the air within the body 8 of the image forming apparatus 150 and sharply raising the temperature of the process cartridge 10K.

The recording media heated by the fixing apparatus 3 and stacked on the recording medium stacking portion 5 also heat the process cartridge 10K through the recording medium stacking portion 5. It is not preferable to excessively raise the temperature of the process cartridge 10K because fluidity of the developer in the developing portion of the process cartridge 10K changes. It is not also preferable to excessively raise the temperature of the air within the body 8 of the image forming apparatus 150 because the temperature of the recording media stacked on the recording medium stacking portion 5 raises and separability between the recording media stacked on the recording medium stacking portion 5 drops.

Accordingly, the image forming apparatus 150 is provided with temperature detecting elements at predetermined positions of the image forming portion 1 in order to stop the image forming process if a rise of temperatures detected by the elements becomes critical.

(Disposition of Temperature Sensors in Comparative Example)

Figure 2:
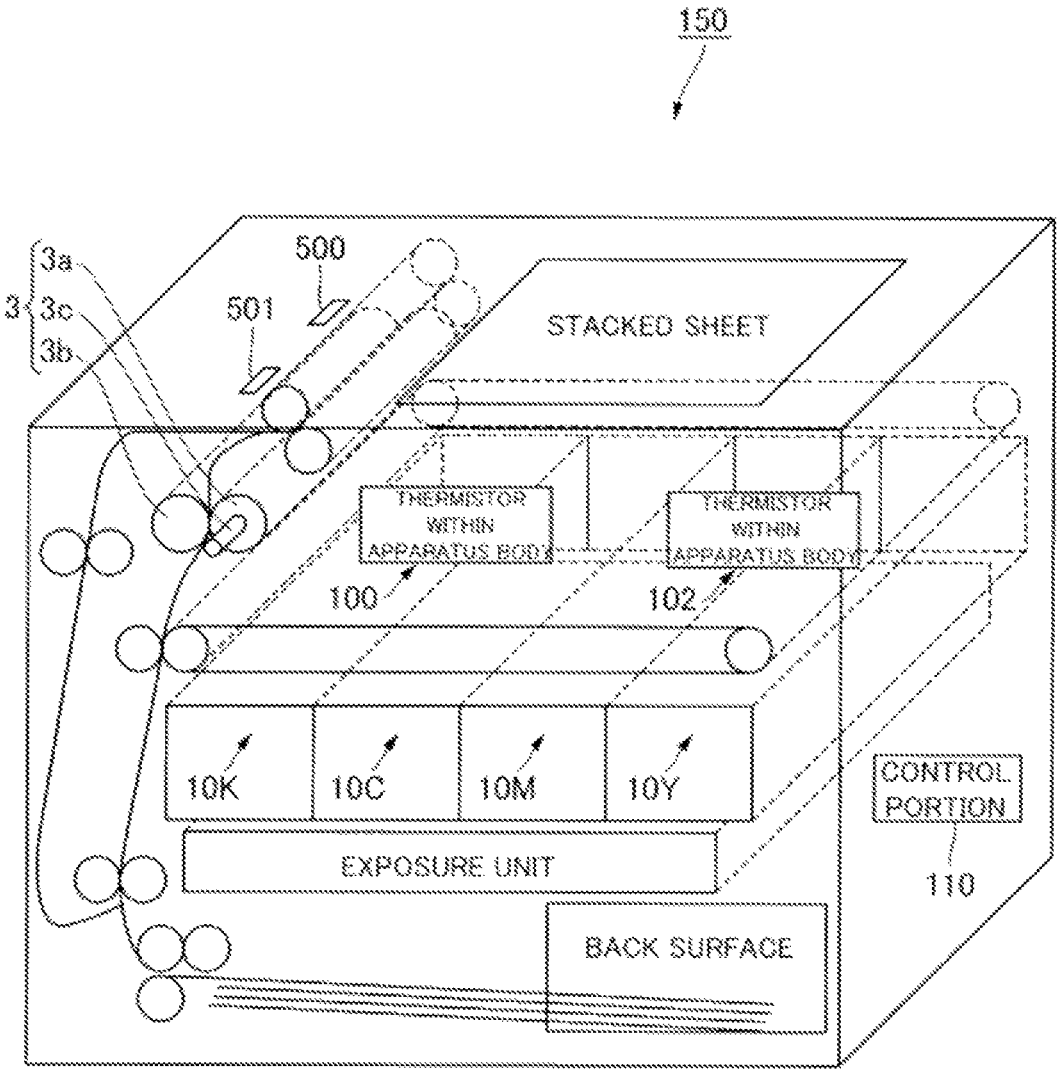
FIG. 2 is a perspective view illustrating a disposition of temperature sensors in a comparative example.

FIG. 2 is a schematic diagram illustrating a disposition of temperature sensors according to a comparative example. That is, an inventor conducted an experiment of measuring a temperature rise within an apparatus body 8 by attaching thermistors at various spots within the image forming portion 1 as shown in FIG. 1, selected spots where a temperature change close to a temperature change within the process cartridge 10K can be detected, and provided thermistors 100 and 102.

As shown in FIG. 2 showing the image forming apparatus 150 viewed from a back thereof, sensor substrates were disposed on frames between the process cartridges 10Y and 10M and the process cartridges 10C and 10K, and the thermistors 100 and 102 were mounted on the sensor substrates. In order to avoid the sensor substrates from being cooled by frames, the sensor substrates were kept while being suspended in midair, and the sensor substrates were connected with a control portion 110 of the image forming apparatus 150 by dedicated bundled wires. The bundled wires include a 5V power line for operating the thermistor, a ground line, and a signal line of temperature signals.

Thus, the dedicated bundled wires for connecting the sensor substrates with the control portion 110 of the image forming apparatus 150 are required in the disposition of the temperature sensors in the comparative example. The comparative example also requires spaces for disposing the sensor substrates, spaces for disposing the bundled wires, and dedicated structures for supporting and protecting the bundled wires within the body 8 of the image forming apparatus 150.

(Disposition of Temperature Sensors according to First Embodiment)

Figure 3:
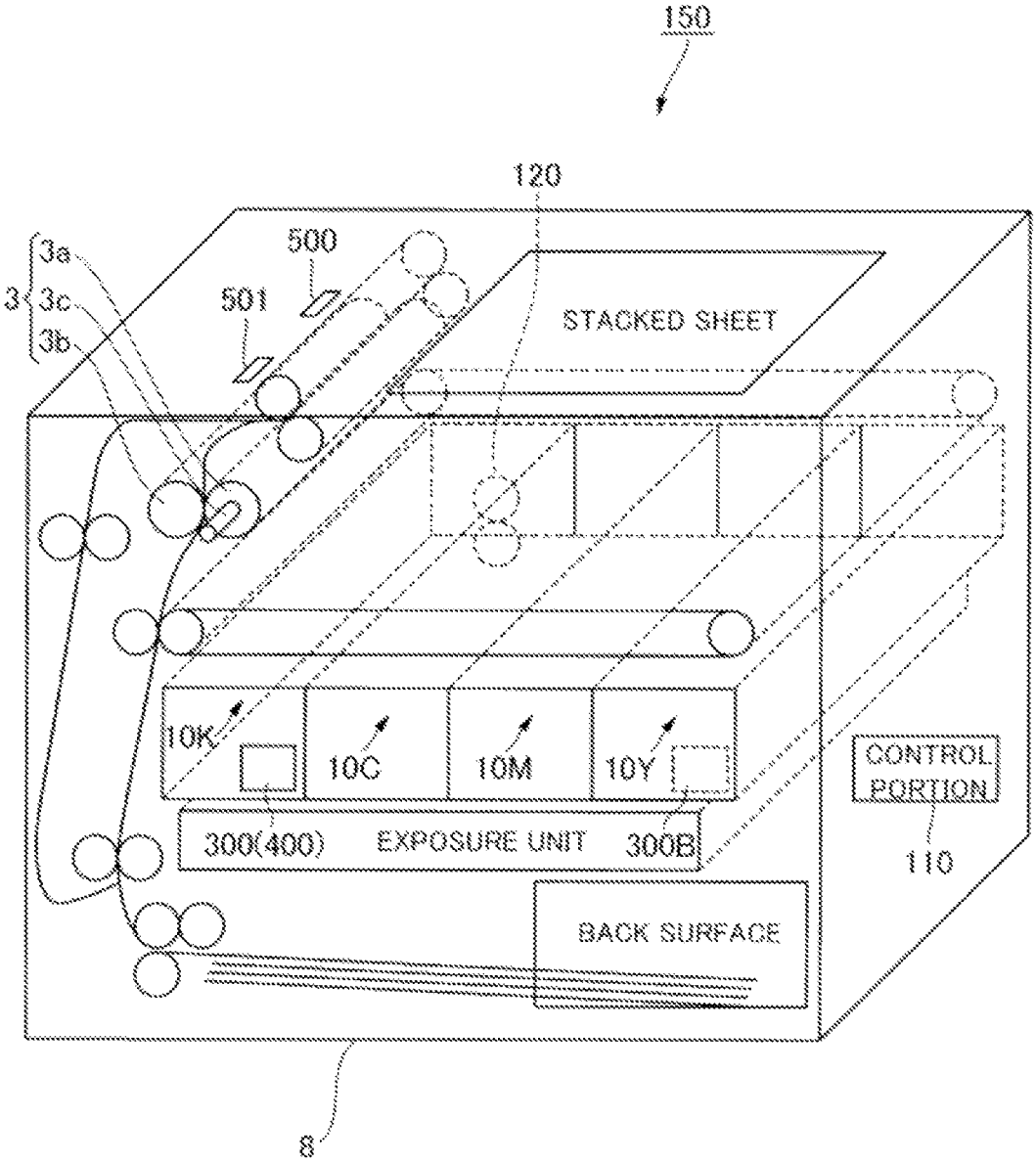
FIG. 3 is a perspective view illustrating a disposition of temperature sensors according to a first embodiment of the invention.
Figure 4A:
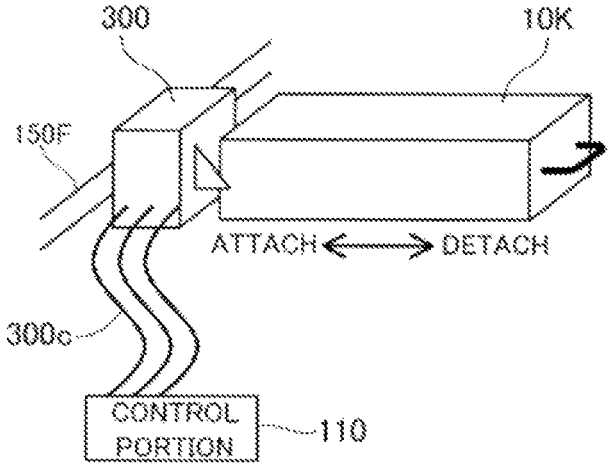
FIG. 4A is a schematic diagram illustrating a connector attached with a temperature sensor.
Figure 4B:
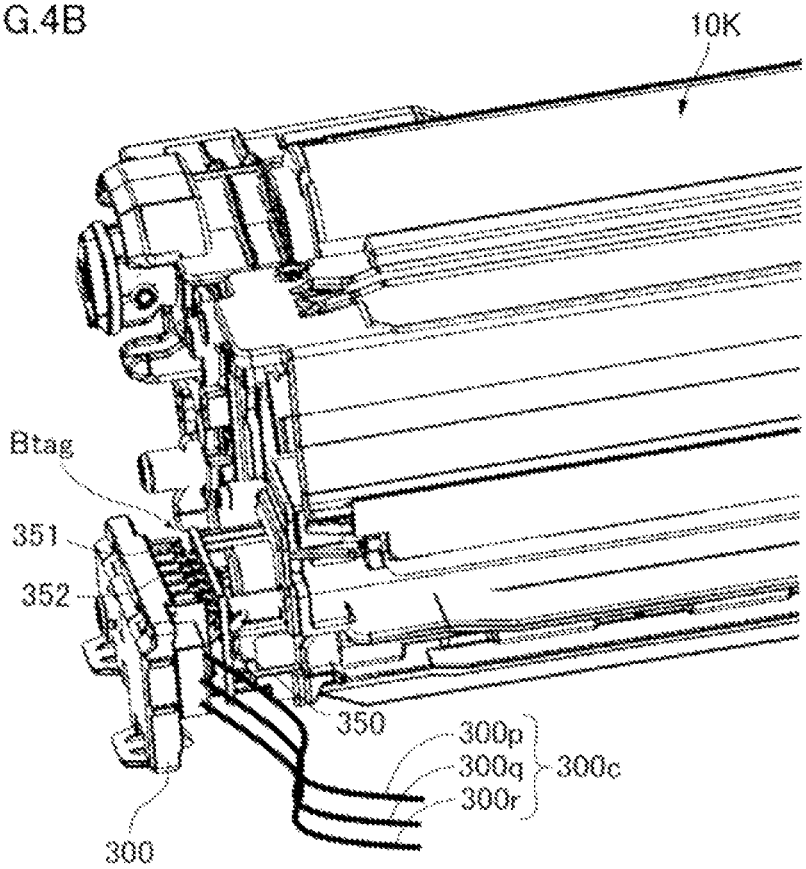
FIG. 4B is a partially enlarged view illustrating a mount portion of the connector attached with the temperature sensor.

FIG. 3 is a schematic diagram illustrating a disposition of temperature sensors according to a first embodiment of the invention. FIG. 4A is a schematic diagram illustrating a connector including the temperature sensor. FIG. 4B is a partially enlarged view of the process cartridge 10K illustrating a mount portion of the connector including the temperature sensor. FIG. 5 is a partially enlarged view of the cartridge and the connector illustrating a heat transmission route between a developing unit 14K and a thermistor. FIG. 6 is a partially enlarged view of the connector 300 illustrating a disposition of the thermistor in the connector. According to the first embodiment of the invention, the temperature detecting element is mounted in the connector 300 on a body side that is connected to and exchanges various signals with the connector Btag on the process cartridge 10K side.

As shown in FIG. 5, a tag board Btag, i.e., one exemplary first connector, is fixed on an outer wall surface of the process cartridge 10K. A connector board Bcon, i.e., one exemplary second connector, is disposed on the side of the body 8 of the image forming apparatus 150 and exchanges electrical signals with the process cartridge 10K. The connector board Bcon is connected detachably to the tag board Btag. The connector board Bcon is fixed to the body 8 of the image forming apparatus 150, so that the connector board Bcon is separated from the tag board Btag in drawing the process cartridge 10K out of the body 8 of the image forming apparatus 150.

The tag board Btag is disposed at an end in the direction of the rotation axis of the photoconductive drum of the process cartridge 10K. A gear train 120 (see FIG. 3) driving the process cartridge 10K impedes transmission of heat, so that the gear train 120 is disposed at an end of a side opposite from the tag board Btag in the direction of the rotation axis of the photoconductive drum of the process cartridge 10K.

As shown in FIG. 4B, A memory element 352 is disposed on a circuit pattern of a printed board (first printed board) 350 of the tag board Btag. Input and output terminals of the memory element 352 are connected to a plurality of electrode terminals 351 of the tag board Btag through the circuit pattern. The plurality of electrode terminals 351 of the tag board Btag are in contact with electrode terminals 300*e* of the electric contact 310 of the connector board Bcon. The circuit pattern of the tag board Btag connects the plurality of electrode terminals 351 with the memory element 352. The memory element 352 records usage history information of the process cartridge 10K.

As shown in FIG. 6, a thermistor 400, i.e., one exemplary temperature detecting element, is disposed on the connector board Bcon. Electric contact 310 with the tag board Btag is formed by a plurality of electrode terminals 300*e* on the connector board Bcon, i.e., one exemplary second printed board, and a circuit pattern connecting these plurality of electrode terminals 300*e*, bundled wires (wiring) 300*c*, and the thermistor 400 is formed on the connector board Bcon. The plurality of electrode terminals 300*e* comes in contact with the plurality of electrode terminals of the tag board Btag. The bundled wires 300*c*, i.e., one exemplary signal transmission portion, are wires connecting the tag board Btag with the control portion 110 provided on the body side, and the connector board Bcon is provided at an end thereof. That is, electrical signals are transmitted (communicated) between the control portion 110 provided in the body 8 and the tag board Btag through the electrode terminals of the tag board Btag, the electrode terminals of the connector board Bcon, and the bundled wires 300*c*.

The thermistor 400 is mounted in the connector board Bcon connected to the process cartridge 10K closest to the secondary transfer portion Ts among the plurality of process cartridges 10Y, 10M, 10C, and 10K shown in FIG. 1.

As shown in FIG. 3, the thermistor 400 is built in a connector 300 fixed to the body 8 of the image forming apparatus 150. The connector 300 is disconnected from the connector on the process cartridge 10K side when the process cartridge 10K is drawn out of a front side of the image forming apparatus 150. The connector 300 is connected also with the connector on the process cartridge 10K side as the process cartridge 10K is pushed in from the front side of the image forming apparatus 150.

As shown in FIG. 4A, the connector 300 is fixed to a frame 150F on a back side of the image forming apparatus 150. The process cartridge 10K is attached/detached to/from the connector 300 on the body side by sliding the process cartridge 10K in a direction of an arrow in FIG. 4A.

As shown also in FIG. 5, the connector board Bcon is disposed within a casing of the connector 300. Meanwhile, the tag board Btag is disposed in contact with the outer wall surface of the process cartridge 10K. The memory element storing usage conditions of the process cartridge 10K is disposed on the circuit pattern of the tag board Btag. The connector board Bcon obtains various data from the memory element through the tag board Btag.

A large number of contact terminals in contact and exchange electrical signals respectively with the electrode terminals of the connector 300 are arrayed on the tag board Btag. Starting from the tag board Btag, various wirings are made to respective parts of the process cartridge 10K. A bearing of a conveying screw 10S of the developing unit 14K of the process cartridge 10K is disposed in contiguity with the tag board Btag. A temperature change of the conveying screw 10S changes a temperature of the tag board Btag via the outer wall surface of the process cartridge 10K.

With an execution of the image forming operation, the control portion 110 records histories of the image forming operation intrinsic to the process cartridge 10K and of replenishment of the developer in the memory element. In addition to various information in replacing the process cartridge 10K anew, various information such as sizes of recording media when images are formed after the replacement, distinction whether simplex or duplex printing is carried out, density of printed images, an input value of a number of sheets in forming each individual image, an accumulated number of sheets on which images have been formed, and others are recorded in the memory element.

Reading the image formation history information from the memory element, the control portion 110 makes a judgment whether the process cartridge 10K is a new product, a used product, or a spent product (empty) in replacing the process cartridge 10K. Reading the image formation history information from the memory element, the control portion 110 also notifies a user concerning a replacement time of the process cartridge 10K.

As shown in FIG. 6, the thermistor 400 is disposed on the connector board Bcon. The electrode terminals 300*e* that come in contact with the contact terminals of the tag board Btag and the circuit pattern are also disposed on the connector board Bcon of the connector 300. The respective electrode terminals 300*e* are connected to individual signal lines included in the bundled wires 300*c* through the circuit pattern of the connector board Bcon. The thermistor 400 is fixed on the circuit pattern of the connector board Bcon. It is preferable to dispose the thermistor 400 at a position thermal-conductively close to the process cartridge 10K as much as possible.

As shown in FIG. 4A, the bundled wires 300*c* include a plurality of signal lines not shown to exchange data between the memory element 352 on the tag board (Btag: see FIGS. 4B and 5) and the control portion 110. The control portion 110 reads data from the memory element and writes new data to the memory element through the signal lines not shown. The control portion 110 recognizes a use state of the process cartridge 10K through the bundled wires 300*c* drawn from the tag board Btag through the connector board Bcon.

As shown in FIG. 4B, the bundled wires 300*c* include three signal lines to detect a temperature by using the thermistor 400, beside the exchange of data. The three signal lines are the 5 V power line (power supplying line) 300*q* for operating the thermistor, the ground wire 300*r*, and the signal line 300*p* transmitting a temperature signal. However, because the 5V power line 300*q* and the ground wire 300*r* are common with a signal line for operating the memory element on the tag board Btag (see FIG. 5), only one signal line is added in the bundled wires 300*c*. The connector board (electrical board) Bcon is configured to be able to supply electric power supplied through the power line 300*q* to the tag board Btag through the electric contact 310 and to thermistor 400.

(Disposition of Temperature Sensors according to First Embodiment)

Figure 7A:
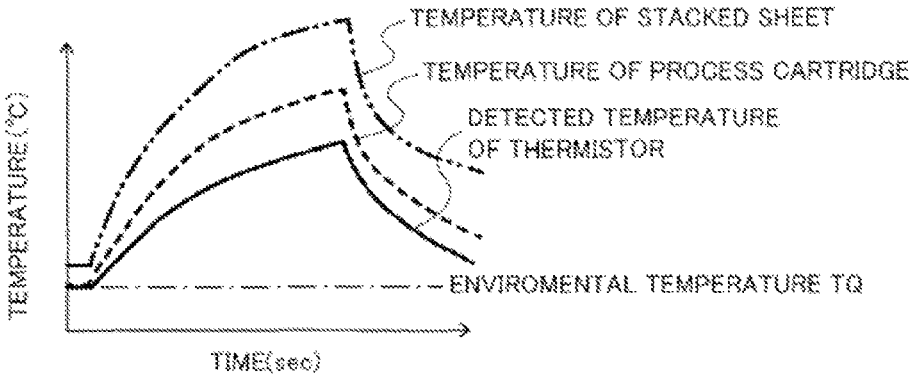
FIG. 7A is a graph showing a result of a temperature detected by the thermistor in a case where the thermistor is provided in the connector attached to a process cartridge on a side closer to the fixing apparatus.
Figure 7B:
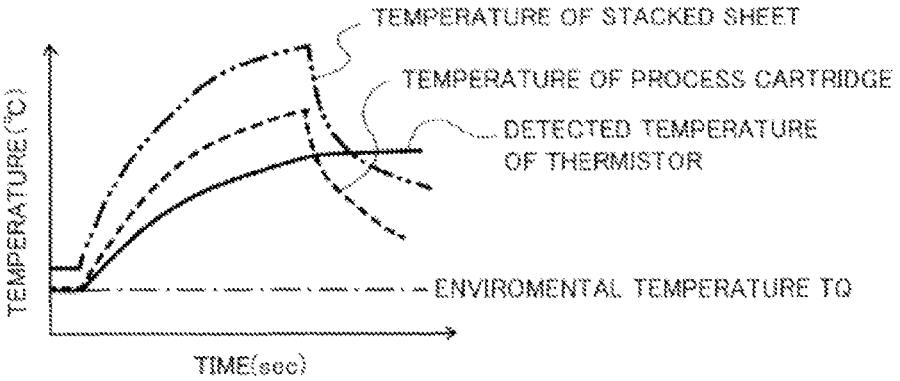
FIG. 7B is a graph showing a result of a temperature detected by the thermistor in a case where the thermistor is provided in the connector attached to a process cartridge on a side distant from the fixing apparatus.

FIGS. 7A and 7B are graphs showing results of temperatures detected by the thermistor in cases where the thermistor is provided in the connector attached to the process cartridge of black on a side closer to the fixing apparatus (FIG. 7A) and is provided in the connector attached to the process cartridge of yellow on a side distant from the fixing apparatus (FIG. 7B).

As shown in FIGS. 1 and 6, the image forming apparatus 150 has the four process cartridges 10Y, 10M, 10C, and 10K and has four connectors 300 corresponding to the process cartridges 10Y, 10M, 10C, and 10K (connectors 300 corresponding to the process cartridges 10Y, 10M, and 10C are not shown). However, according to the first embodiment of the invention, the thermistor 400 is disposed only in the connector 300 of the black process cartridge 10K.

The inventor installed experimental thermistors in the recording medium stacking portion 5 and the developing unit 14K of the process cartridge 10K shown in FIG. 1 to study a correlation between temperatures detected by the experimental thermistors and a temperature detected by the thermistor in the connector 300 as shown in FIGS. 7A and 7B.

As shown in FIG. 7A, in a case where the thermistor 400 was disposed in the connector 300 of the black process cartridge 10K which is closest to the fixing apparatus 3 among the process cartridges, the thermistor 400 detected temperatures following an increase/drop of the internal temperature of the developing unit 14K of the process cartridge 10K.

In a case where the thermistor 400 was disposed in the connector 300 of the yellow process cartridge 10Y which is distant most from the fixing apparatus 3 among the process cartridges, the thermistor 400 could not detect temperatures following the increase/drop of the internal temperature of the developing unit 14K of the process cartridge 10K as shown in FIG. 7B.

It is possible to improve tracking performance of the temperature detected from a calorific value of the fixing apparatus 3 by attaching the connector 300 including the thermistor 400 detecting the temperature to the process cartridge 10K which is closest to the fixing apparatus 3 and which is placed under a severe temperature condition as shown in FIG. 1. That is, because inclinations of the temperature rise and cooling of the process cartridge 10K and of the temperature detected by the thermistor 400 orient in the same direction, it is possible to accurately estimate the temperature within the process cartridge 10K.

Although levels of the temperature of the recording medium stacking portion 5 and the temperature within the developing unit 14K of the process cartridge 10K are different from that of the temperature detected by the thermistor 400, patterns of the temperature rise and cooling and the inclinations of the temperature changes at each time coincide from each other. Therefore, it is possible to estimate the temperature of the recording medium stacking portion 5 and the temperature within the developing unit 14K of the process cartridge 10K just by multiplying the temperature detected by the thermistor 400 by predetermined correlation functions (1.6 and 1.3).

Meanwhile, if a distance between the process cartridge 10K and the connector 300 including the thermistor 400 detecting the temperature is distant too far, shifts between their patterns of temperature rise and cooling and inclinations of temperature change at each time increase. Their inclinations of temperatures in increasing the temperature and in stopping and cooling the process cartridge 1K are also largely differentiated. Therefore, the temperature detected by the thermistor 400 does not drop even if the temperature of the recording medium stacking portion 5 and the temperature within the developing unit 14K of the process cartridge 10K drop as shown in FIG. 7B, thus increasing a temperature estimation error.

(Disposition of Temperature Sensors Detecting Temperature of Fixing Apparatus)

Figure 8:
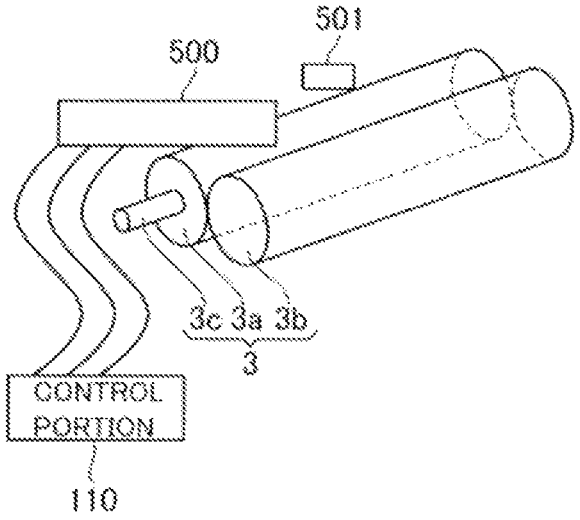
FIG. 8 is a schematic diagram illustrating a disposition of the temperature sensor detecting a temperature of a fixing roller.

FIG. 8 is a schematic diagram illustrating a disposition of temperature sensors detecting temperatures of the fixing roller.

As shown in FIG. 2, when the image forming apparatus 150 is viewed from the backside thereof, a thermistor 501 is disposed in contact with a center part in a longitudinal direction of the fixing roller 3*a*. The control portion 110 controls ON/OFF of input power of a heating unit 3*c* such that a temperature of the fixing roller 3*a* detected by the thermistor 501 is kept at a fixing temperature (180° C.).

As shown in FIG. 8 in detail, a different thermistor 500 is disposed in contact with an outside (non-passing parts) of a region with which a recording medium of A4 size when fed horizontally comes in contact of the fixing roller 3*a*. When images are formed continuously on small size recording media such as A5 size when fed vertically, a temperature rise occurs at the non-passing parts at both ends of the fixing roller 3*a* as heat is not removed by the recording media even though those parts are heated by the heating unit 3*c*. In order to avoid an excessive temperature rise at the ends of the fixing roller 3*a* caused by the temperature rise at the non-passing part, the control portion 110 extends intervals between toner images formed in the image forming portion 1 stepwise if the temperature detected by the thermistor 500 exceeds a specified value, e.g., 220° C.

(First Example of Temperature Control)

FIGS. 9A and 9B are graphs illustrating an intra-apparatus body temperature and productivity of an image forming process, i.e., a number of images formed per unit time, in a case where the control of intervals of the images is executed based on an estimated temperature. According to a first example of the temperature control, the control portion 110 lowers the productivity stepwise by predicting an excessive temperature rise within the apparatus body 8. Specifically, the control portion 110 makes communication with the thermistor 400 through the bundled wire 300*c* shown in FIG. 4 and changes the intervals of the toner images formed on the photoconductive drum 11K on a basis of an output of the thermistor 400. The control portion 110 changes the image intervals stepwise such that the estimate temperature within the process cartridge 10K does not exceed an upper limit of an adequate temperature range on a basis of a temperature detected by the thermistor 400.

As shown in FIG. 9A, specific temperatures T1, T2, and T3 are set as threshold values of the intra-apparatus body temperature. When the image forming apparatus 150 starts a consecutive image forming process, the estimate temperature within the process cartridge 10K rises due to the temperature rise within the body 8 of the image forming apparatus 150.

The estimate temperature is a value obtained by multiplying the temperature detected by the thermistor 400 by the correlation function of 1.3.

When the estimate temperature reaches the specific temperature T1, the control portion 110 extends the intervals (pitches) of the toner images formed on the photoconductive drums 11Y, 11M, 11C, and 11K while keeping a process speed as it is. When the image intervals are extended, intervals of the recording media fed to the secondary transfer portion Ts are also extended followingly. Thereby, a quantity of heat radiated by the fixing apparatus 3 and the heat-processed recording media to a space within the body 8 of the image forming apparatus 150 is lowered, so that the inclination of the temperature rise of the estimate temperature within the process cartridge 10K is moderated.

When the temperature rise of the process cartridge 10K advances further and the estimate temperature reaches the specific temperature T2, the control portion 110 prohibits toner images from being formed on the photoconductive drums 11Y, 11M, 11C, and 11K. When the formation of the toner images is stopped, no recording medium is also fed to the secondary transfer portion Ts followingly. Thereby, the estimate temperature within the process cartridge 10K starts to drop.

When cooling of the process cartridge 10K advances and the estimate temperature is lowered to the specific temperature T3, the control portion 110 starts the image forming process again by the extended image intervals described above. When the temperature rise of the process cartridge 10K advances and the estimate temperature reaches the specific temperature T2 after starting the image forming process again, the control portion 110 stops toner images from being formed on the photoconductive drums 11Y, 11M, 11C, and 11K again and stops recording media from being fed.

As shown in FIG. 9B, images are formed consecutively with high productivity until when the estimate temperature within the process cartridge 10K reaches the specific temperature T1. The control portion 110 continues the image forming process while dropping the productivity when the estimate temperature within the process cartridge 10K is equal to or higher than the specific temperature T1 and lower than the specific temperature T2. The productivity is zeroed when the estimate temperature within the process cartridge 10K is equal to or higher than the specific temperature T2.

It is noted that even if the estimate temperature within the process cartridge 10K is lower than the specific temperature T2, the control portion 110 stops the image forming process if the thermistor 500 detects the specific temperature T2 due to the temperature rise caused at the non-passing part of the fixing roller 3*a* of the fixing apparatus 3 shown in FIG. 8.

(Second Example of Temperature Control)

FIGS. 10A and 10B are graphs illustrating the intra-apparatus body temperature and the productivity of the image forming process in a case where another control of image intervals is executed based on the estimated temperature. Based on a temperature detected by the thermistor 400 (see FIG. 6), the control portion 110 shown in FIG. 4A stops the image forming process when the temperature within the process cartridge 10K reaches the upper limit of the adequate temperature range.

As shown in FIG. 10A, specific temperatures T2 and T3 are set as threshold values of the intra-apparatus body temperature. When the image forming apparatus 150 starts a consecutive image forming process, the estimate temperature within the process cartridge 10K rises due to the temperature rise within the body 8 of the image forming apparatus 150. The estimate temperature is a value obtained by multiplying the temperature detected by the thermistor 400 by the correlation function of 1.3.

When the estimate temperature within the process cartridge 10K reaches the specific temperature T2, the control portion 110 prohibits toner images from being formed on the photoconductive drums 11Y, 11M, 11C, and 11K and stops recording media from being fed. Thereby, the estimate temperature within the process cartridge 10K drops.

When cooling of the process cartridge 10K advances and the estimate temperature is lowered to the specific temperature T3, the control portion 110 starts the image forming process again. When the estimate temperature within the process cartridge 10K reaches the specific temperature T2 after starting the image forming process again, the control portion 110 stops toner images from being formed on the photoconductive drums 11Y, 11M, 11C, and 11K again and stops recording media from being fed.

As shown in FIG. 10B, images are formed consecutively with high productivity until when the estimate temperature within the process cartridge 10K reaches the specific temperature T2. The productivity is zeroed when the estimate temperature within the process cartridge 10K reaches the specific temperature T2 until when the estimate temperature drops to the specific temperature T3.

(Advantageous Effects of First Embodiment)

The image forming apparatus 150 of the first embodiment requires no new thermistor in replacing the process cartridge 10K which is a consumable item because the thermistor is not mounted to the process cartridge 10K. Accordingly, parts costs of the process cartridge 10K can be lowered.

The thermistor 400 detecting the temperature of the image forming portion 1 is mounted in the connector 300 detachably attached to the process cartridge 10K in the image forming apparatus 150 of the first embodiment. Therefore, it is not necessary to attach the thermistors between the process cartridges 10C and 10K as described in the comparative example. No thermistor needs to be also mounted on the recording medium stacking portion 5.

Although the connector board Bcon is slightly enlarged as compared to a conventional one because the thermistor 400 is mounted in the connector in the image forming apparatus 150 of the first embodiment, a total area of the board may be small as compared to a case of adding a new board only for providing the thermistor 400. No space for disposing a dedicated board including the thermistor is also required.

Because the thermistor 400 is disposed within the existing connector board Bcon in the image forming apparatus 150 of the first embodiment, no space for disposing the thermistor 400 needs to be provided within the connector 300. The image forming apparatus 150 of the first embodiment also requires no new board for mounting the thermistor 400 to be prepared and no space for disposing a new board to be assured around the process cartridge 10K. Because the 5 V power line for operating the thermistor 400 and the ground line already exit on the connector board Bcon, a substantial change is just to increase one signal line. No bundled wire for applying power supply voltage for operating the thermistor is also required. No circuit pattern or signal line dedicated for applying the power supply voltage to the thermistor 400 are also required.

The thermistor 400 is disposed such that the thermistor 400 receives heat conducted directly from the process cartridge 10K whose internal temperature is to be estimated in the image forming apparatus 150 of the first embodiment. That is, the thermistor 400 is disposed at the position close to the process cartridge 10K and the stacked recording media whose temperatures rise. Therefore, the patterns of temperature changes when the temperature detected by the thermistor 400 rises or drops and the inclination of the temperature change at each time become similar to the pattern and inclination of the internal temperature of the process cartridge 10K. Accordingly, it is possible to accurately estimate the internal temperature of the process cartridge 10K whose temperature tends to increase by being influenced by the fixing apparatus 3 and the temperature of the recording media on which images have been formed and which are stacked on the recording medium stacking portion 5 from the temperature detected by the thermistor 400. Because the control portion 110 accurately estimates the internal temperature of the process cartridge 10K based on the temperature detected by the thermistor 400 and keeps the estimate temperature below the specific temperature T2 by restricting the cartridge from forming toner images, it is possible to reliably prevent fluidity of the developer from dropping otherwise caused by an excessive temperature rise. That is, the temperature of the developer within the process cartridge 10K hardly rises by exceeding the adequate temperature range.

The image forming apparatus 150 of the first embodiment contributes to downsizing, noise-reducing, and cutting parts costs of the image forming apparatus 150 because it requires no fan, duct or cooler for cooling the process cartridge 10K. The image forming apparatus 150 of the first embodiment enables to avoid the excessive temperature rise of the process cartridge 10K without suctioning heated air out of the apparatus by disposing air ducts respectively at heat generating spots within the image forming apparatus 150. The image forming apparatus 150 of the first embodiment can also reduce a burden of cooling of a room air conditioner otherwise caused by the high temperature air discharged out of the image forming apparatus 150. It is not also necessary to remove heat radiated individually by using cooling units other than the fan such as a refrigerator and a heat pump.

Second Embodiment

Figure 11:
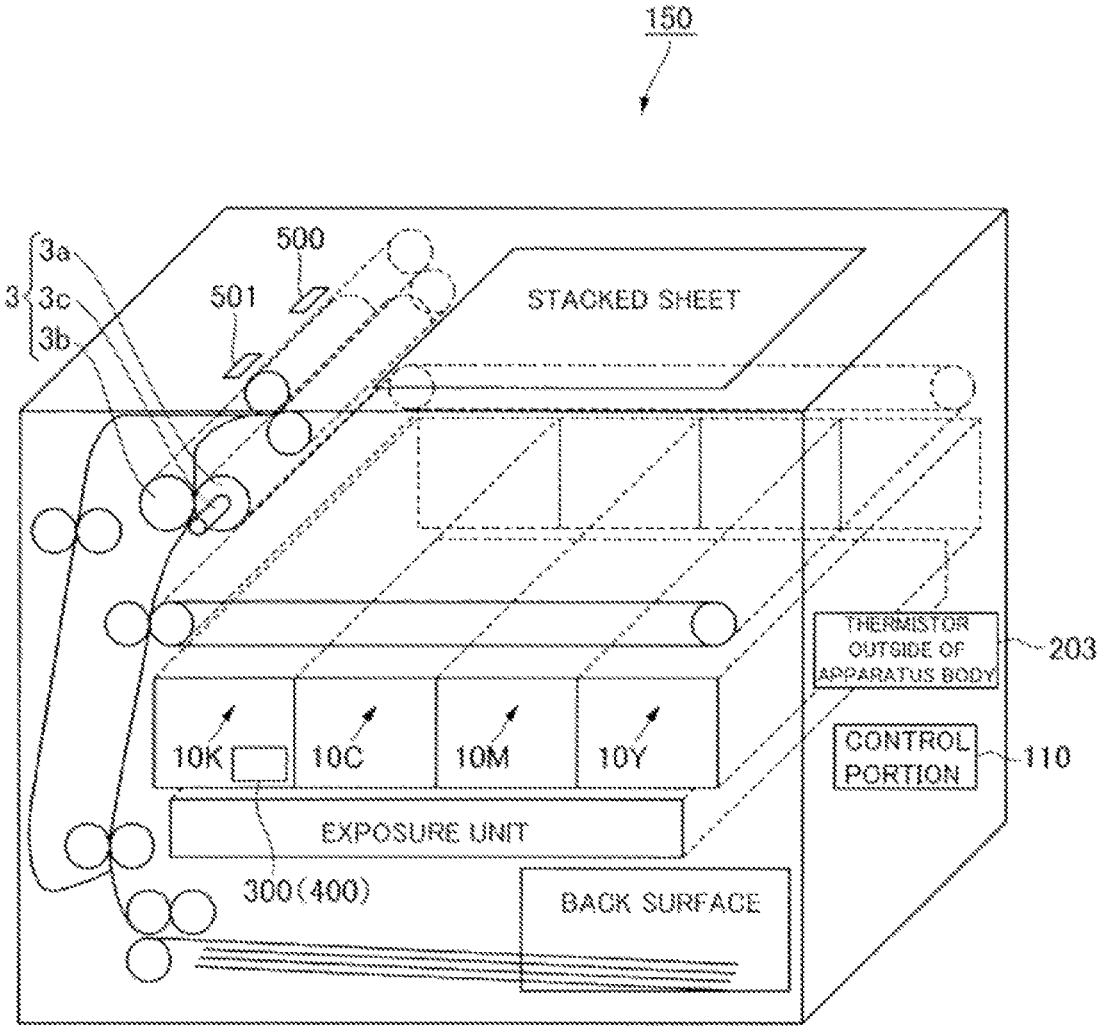
FIG. 11 is a perspective view illustrating a disposition of temperature sensors according to a second embodiment.
Figure 12:
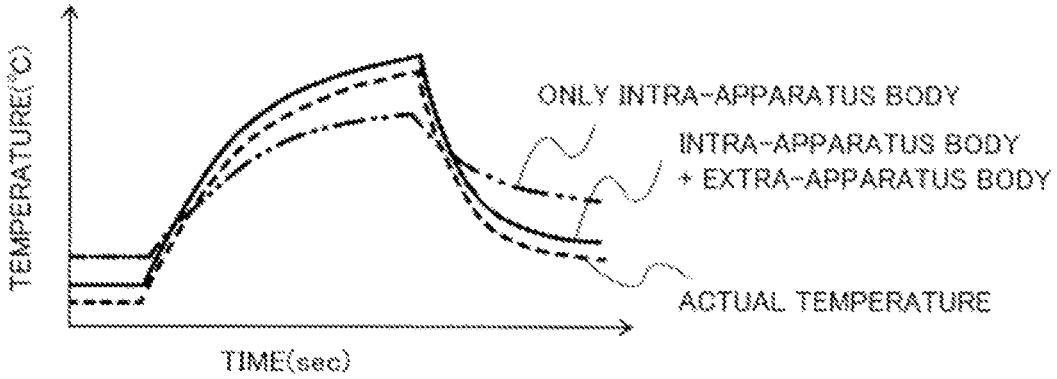
FIG. 12 is a graph illustrating an effect of using an ambient temperature sensor located outside of the apparatus in combination.

FIG. 11 is a perspective view illustrating a disposition of temperature sensors according to a second embodiment. FIG. 12 is a graph illustrating an effect of using an ambient temperature sensor located outside of the apparatus in combination. The accuracy of the estimation of the internal temperature of the process cartridge 10K is enhanced by using the temperature sensor of the process cartridge described in the first embodiment together with the temperature sensor detecting an ambient temperature (extra-apparatus body temperature sensor).

As shown in FIG. 11, the extra-apparatus body thermistor 203 is disposed on a side wall of the image forming apparatus 150 while being exposed to a space out of the apparatus body 8. The extra-apparatus body thermistor 203 measures an ambient temperature of the image forming apparatus 150, i.e., a temperature of air within a room in which the apparatus is installed.

An estimate temperature TB1 of the process cartridge 10K estimated by using only the temperature TC detected by the thermistor 400, and an estimate temperature TB2 estimated by using the temperature TC detected by the thermistor 400 and a temperature TO detected by the extra-apparatus body thermistor 203 are obtained by the following equations:

$$TB1 = \text{correction coefficient} \times TC$$

$$TB2 = TO + \text{correction coefficient} \times (TC - TO)$$

As shown in FIG. 12, a thin two-dot chain line represents the estimate temperature TB1 based only on the detected temperature TC. A thick solid line represents the estimate temperature TB2 in which the detected temperature TO of the extra-apparatus body thermistor 203 is added. A broken line represents an actual temperature Tj detected by an experimental thermistor provided within the process cartridge 10K.

As compared to the actual temperature Tj, the estimate temperature TB2 in which the temperature TO detected by the extra-apparatus body thermistor 203 is added makes it possible to estimate the internal temperature of the process cartridge 10K at higher precision than the estimate temperature TB1 using only the temperature detected by the thermistor 400. It is because a temperature in a steady time can be accurately reflected by accurately measuring the ambient temperature.

The image forming apparatus 150 of the second embodiment makes it possible to accurately estimate temperatures of the heated process cartridge and stacked recording media by using the sensor located outside of the apparatus body 8 in combination. Accordingly, the image forming apparatus 150 of the second embodiment makes it also possible to reduce noise and to downsize the apparatus by accurately estimating the temperatures of the spots severely heated and of the recording media even if a large number of sheets is to be printed out in an image forming job under a high temperature environment.

Other Embodiments

The present invention can be carried out even by other embodiments in which a part or a whole of the components of the embodiments described above is replaced with its substitutive components as long as the temperature sensor is disposed in the electrical connector connected to the developing unit or the process cartridge. Accordingly, the present invention can be carried out by the image forming apparatus in which the image forming portion and the image heating portion are disposed within one body regardless types of the image forming apparatus, i.e., a direct transfer type, a recording medium conveying type, an intermediate transfer type, or one-drum type intermediate transfer type apparatus. The image forming portion can be also carried out regardless a charging type, an exposure type, a development type, a transfer type, or a cleaning type. The image heating portion can be also carried out regardless a roller type, belt type, and belt/roller type.

The sizes, materials, shapes, their relative disposition or the like of the components described in the first and second embodiments are not intended to limit a scope of the invention to them unless specifically described. While only the main parts related to the formation and transfer of toner images have been described in the embodiments described above, the present invention can be carried out in various uses such as a printer, various printing machines, a copier, a facsimile, and a multi-function printer by adding required devises, units and a body structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-109998, filed May 24, 2013, which is hereby incorporated by reference herein in its entirety.

What is claimed is:

1. An image forming apparatus comprising:

a developing unit developing an electrostatic image on a photoconductive body as a toner image by using developer;

a body to which the developing unit is detachably mounted;

a first connector fixed to the developing unit;

a second connector disposed on the body side and detachably connected to the first connector to electrically communicate with the first connector; and a temperature detecting element disposed on the second connector.

2. An image forming apparatus comprising:

a cartridge, detachably mountable to the image forming apparatus, including toner;

an information recording portion, provided on the cartridge, configured to record information;

an electric board provided in the image forming apparatus;

a connector, provided on the electric board, configured to electrically connect to the information recording portion and to receive information from the information recording portion;

a temperature detecting portion, provided on the electric board, configured to detect temperature; and an electric power input portion, provided on the electric board, configured to supply electric power to both the information recording portion through the connector and the temperature detecting portion.

3. The image forming apparatus according to claim 2, wherein the cartridge includes a photoconductive body and a developing roller for developing an electrostatic image formed on the photoconductive body.

4. The image forming apparatus according to claim 3, wherein the information recording portion is disposed at an end of the cartridge in a direction of a rotational axis of the photoconductive body.

5. The image forming apparatus according to claim 4, wherein the cartridge includes a gear train driving the developing roller and provided on another end in the direction of the rotational axis of the photoconductive body at a side opposite to the information recording portion.

6. The image forming apparatus according to claim 4, wherein information is capable of being transmitted to the information recording portion from the connector.

7. The image forming apparatus according to claim 2, wherein electric power is supplied to the electric power input portion through an electric line.

8. The image forming apparatus according to claims 2, wherein the information recording portion includes a plurality of electrode terminals that come in contact with electrode terminals of the electric contact of the connector, a memory element recording the history information of usage of the cartridge, and a printed circuit board on which a circuit pattern connecting the plurality of electrode terminals with the memory element is formed.

9. An image forming apparatus comprising:

a cartridge, detachably mountable to the image forming apparatus, including a photoconductive body for carrying a toner image;

an information recording portion, provided on the cartridge, configured to record information;

an electric board provided in the image forming apparatus;

a connector, provided on the electric board, configured to electrically connect to the information recording portion and to receive information from the information recording portion;

a temperature detecting portion, provided on the electric board, configured to detect temperature; and an electric power input portion, provided on the electric board, configured to supply electric power to both the information recording portion through the connector and the temperature detecting portion.

10. The image forming apparatus according to claim 9, wherein the cartridge includes a developing unit for developing an electrostatic image formed on the photoconductive body.

11. The image forming apparatus according to claim 9, wherein the information recording portion is disposed at an end of the cartridge in a direction of a rotational axis of the photoconductive body.

12. The image forming apparatus according to claim 11, wherein the cartridge includes a gear train driving a developing roller for developing an electrostatic image formed on the photoconductive body and provided on another end in the direction of the rotational axis of the photoconductive body at a side opposite to the information recording portion.

13. The image forming apparatus according to claim 9, wherein the electric power is supplied to the electric power input portion through an electric line.

14. The image forming apparatus according to claim 9, wherein information is capable of being transmitted to the information recording portion from the connector.

15. The image forming apparatus according to claim 9, wherein the information recording portion includes a plurality of electrode terminals that come in contact with electrode terminals of the electric contact of the connector, a memory element recording the history information of usage of the developing unit, and a printed circuit board on which a circuit pattern connecting the plurality of electrode terminals with the memory element is formed.

16. An image forming apparatus comprising:

a drum unit including a photosensitive drum;

a body to which the drum unit is detachably mounted;

a first connector fixed to the drum unit;

a second connector disposed on the body side and detachably connected to the first connector to electrically communicate with the first connector; and a temperature detecting element disposed on the second connector.

* * * * *